US006797120B2

(12) United States Patent
Nonomura

(10) Patent No.: US 6,797,120 B2
(45) Date of Patent: Sep. 28, 2004

(54) METHOD OF MANUFACTURING PULP MOLD FORMED BODY

(75) Inventor: Akira Nonomura, Tochigi (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 10/410,194

(22) Filed: Apr. 10, 2003

(65) Prior Publication Data

US 2003/0209337 A1 Nov. 13, 2003

Related U.S. Application Data

(63) Continuation of application No. 09/889,566, filed as application No. PCT/JP00/00114 on Jan. 12, 2000, now Pat. No. 6,592,720.

(30) Foreign Application Priority Data

Jan. 29, 1999 (JP) ..... 11-021508

(51) Int. Cl.[7] ..... D21J 3/10; D21J 7/00

(52) U.S. Cl. ..... 162/220; 162/224; 162/228; 162/401; 162/198; 162/263

(58) Field of Search ..... 162/218, 220–224, 162/228–230, 387–416, 199, 263; 264/40.2, 40.3, 40.4, 86, 87, 301, 314; 425/84, 85, 417, 526

(56) References Cited

U.S. PATENT DOCUMENTS

| | | | | |
|---|---|---|---|---|
| 342,178 A | | 5/1886 | Carmichael | |
| 1,324,935 A | * | 12/1919 | Sims | 162/220 |
| 2,416,680 A | * | 3/1947 | Curtis | 162/400 |
| 2,704,493 A | * | 3/1955 | Randall | 206/521.1 |
| 2,894,869 A | * | 7/1959 | Foote | 162/224 |
| 2,961,043 A | * | 11/1960 | Hicks | 162/401 |
| 3,236,722 A | * | 2/1966 | Box | 162/222 |
| 3,284,917 A | * | 11/1966 | Foote | 34/441 |
| 3,929,564 A | | 12/1975 | Reifers | |
| 4,132,591 A | | 1/1979 | Merges, Jr. | |
| 4,448,640 A | | 5/1984 | Brault et al. | |
| 4,929,308 A | | 5/1990 | Gerault et al. | |
| 5,356,518 A | * | 10/1994 | Kelley et al. | 162/224 |
| 6,605,187 B1 | | 8/2003 | Nonomura et al. | |

FOREIGN PATENT DOCUMENTS

| | | |
|---|---|---|
| CN | 1030175 | 11/1995 |
| JP | 35-9669 | 7/1960 |
| JP | 57-149600 | 9/1982 |
| JP | 6-24860 | 9/1994 |
| JP | 6-316900 | 11/1994 |
| JP | 7-42100 | 2/1995 |
| JP | 2000-027098 | 1/2000 |

* cited by examiner

*Primary Examiner*—Peter Chin
*Assistant Examiner*—Eric Hug
(74) *Attorney, Agent, or Firm*—Oblon, Spivak, McClelland, Maier & Neustadt, P.C.

(57) ABSTRACT

A method for producing a pulp molded article is disclosed. The method comprises the steps of forming and drying a pulp molded precursor (15). The drying step includes a first step and a second step. In the first step, the precursor (15) is set in a cavity of a heating mold, and is hot-pressed. The cavity has a configuration in conformity to the contour of the pulp molded article to be produced. In the second step, the hot-pressed precursor (15) is taken out from the heating mold and is heat-dried in a drying furnace.

6 Claims, 2 Drawing Sheets

METHOD OF MANUFACTURING PULP MOLD FORMED BODY

This application is a Continuation of application Ser. No. 09/889,566, now U.S. Pat. No. 6,592,720, filed on Aug. 9, 2001 which is the National stage application of PCT/JP00/00114, filed Jan. 12, 2000.

TECHNICAL FIELD

The present invention relates to a method for producing pulp molded articles.

BACKGROUND ART

Drying methods adoptable in the production of pulp molded articles include a method in which a pulp molded precursor obtained by a papermaking step is dried in a drying furnace by a predetermined heating means. This method is disadvantageous in that the resulting molded articles have poor dimensional accuracy because of incapability of shape control and that a large drying furnace is required because of the low heat conduction efficiency in drying. Additionally, the resulting molded articles have unsatisfactory surface properties and poor strength due to a low pulp density.

Another drying method is a hot pressing method in which a pulp molded precursor obtained by a papermaking step is hot-pressed in a heating mold as described in JP-A-7-42100. According to this drying method, molded articles can be obtained with good dimensional accuracy, and the drying time is shortened owing to the high heat conduction efficiency. However, because drying is accompanied by a physical phenomenon that energy necessary for evaporation is supplied by heat conduction, the time for drying, however it is shortened, is still long as compared with the time for a papermaking and dewatering step. Accordingly, a larger number of heating molds than forming molds should be prepared, which increases the cost of equipment, leading to an increase of production cost. Elevation of the heating mold temperature to reduce the drying time is apt to cause color change (sometimes scorching) of the molded articles.

Conventional containers comprising pulp molded articles are required to have surface strength to some extent so that labels adhered may not separate or a coating applied may not peel. On the other hand, containers comprising pulp molded articles are required to be flexible similarly to plastic containers.

DISCLOSURE OF THE INVENTION

Accordingly, an object of the present invention is to provide a method of producing a pulp molded article, which is successful in shortening the time for drying and reducing the size of drying equipment, thereby reducing the production cost.

Another object of the present invention is to provide a method of producing a pulp molded article, which is capable of controlling density and flexibility while maintaining constant surface strength thereby imparting rigidity or flexibility as required for the use of the molded article.

The present invention accomplishes the above objects by providing a method for producing a pulp molded article comprising the steps of forming a pulp molded precursor from a pulp slurry by means of a forming mold and then heat-drying the precursor, wherein the step of heat-drying includes:

a first step in which the precursor is set in a cavity of a heating mold, the cavity having a configuration in conformity to the contour of the pulp molded article to be produced, and is hot-pressed, and a second step in which the hot-pressed precursor is taken out from the heating mold and is heat-dried in a drying furnace.

The present invention also provides an apparatus for producing a pulp molded article which can preferably be used to carry out the above-described method of producing a pulp molded article, which includes:

a first heat drying means comprising a heating mold having a cavity, a pressing member which presses a pulp molded precursor set in the cavity of the heating mold toward the cavity, and a measuring instrument for measuring the water content, the weight or the temperature of the precursor, a second heat drying means comprising a drying furnace where the precursor which has been heat-dried to a prescribed water content by the first heat drying means is further heat-dried, and a transfer means for transferring the precursor from the first heat drying means to the second heat drying means based on the data of the water content, the weight or the temperature of the precursor as measured with the measuring instrument.

BEST MODE FOR CARRYING OUT THE INVENTION

Figures 1A, 1B, 1C, 1D:
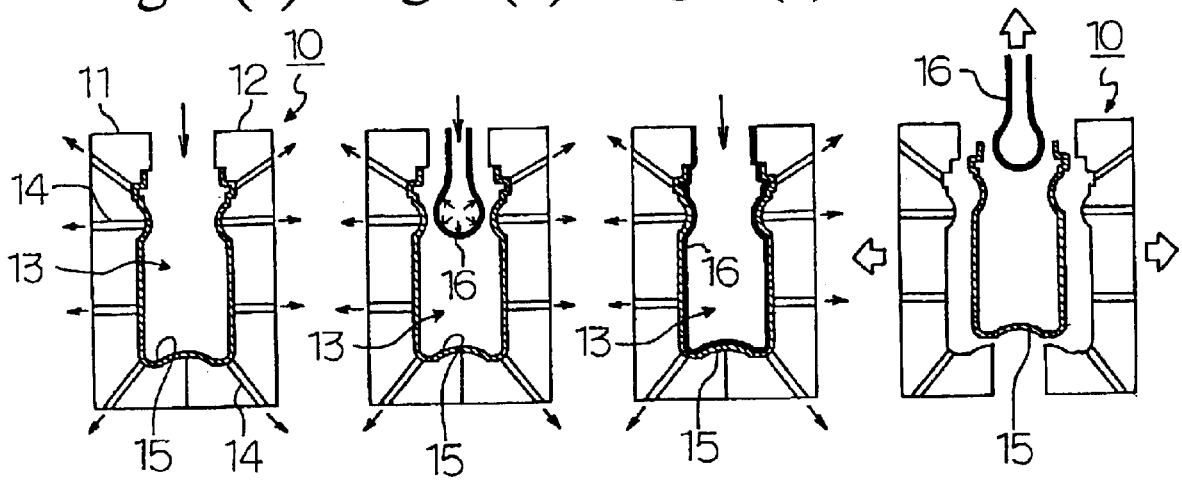
FIGS. 1(*a*) through (*d*) schematically illustrate the step of papermaking and dewatering in an embodiment of the method of producing a pulp molded article according to the present invention, wherein FIG. 1(*a*) is the step of papermaking, FIG. 1(*b*) is the step of inserting a pressing member, FIG. 1(*c*) is the step of pressing and dewatering, and FIG. 1(*d*) is the step of opening a papermaking mold to remove a pulp molded precursor.

The method of producing a pulp molded article according to the present invention will be described with particular reference to its preferred embodiment by way of the accompanying drawings. The method of the invention comprises, as roughly classified, (1) the step of papermaking and dewatering, (2) a first heat drying step, and (3) a second heat drying step. In FIG. 1 is shown the papermaking and dewatering step of the method. Specifically, FIG. 1(*a*) is the step of papermaking, FIG. 1(*b*) is the step of inserting a pressing member, FIG. 1 (*c*) is the step of pressing and dewatering, and FIG. 1 (*d*) is the step of opening a forming mold to take a pulp molded precursor out.

To begin with, the papermaking step is conducted as shown in FIG. 1(*a*). A pulp slurry is injected into a forming mold 10 from its upper opening. The forming mold 10 comprises a pair of mold parts 11 and 12 which are assembled together to form a depression or cavity 13 of prescribed configuration. Each of the mold parts 11 and 12 has a plurality of interconnecting holes 14 which connect the outer side thereof and the cavity 13. The inner surface of the mold parts 11 and 12 is covered with a net (not shown) of prescribed mesh. The configuration of the cavity 13, i.e., the depression is not particularly limited. In this embodiment, the cavity 13 has a configuration in conformity to the outer contour of a pulp molded article to be produced.

Then the cavity 13 is evacuated from the outside of the mold parts 11 and 12 to suck water of the pulp slurry and to deposit pulp fibers on the surface of the cavity 13. As a result, the pulp fibers are built up on the surface of the cavity 13 to a prescribed thickness into a pulp molded precursor 15.

The pulp slurry can be made of pulp fiber and water. It can contain other components such as inorganic substances such as talc and kaolinite, inorganic fibers such as glass fiber and carbon fibers, powder or fiber of synthetic resins such as polyolefins, nonwood or plant fibers, and polysaccharides. The proportion of the other components is preferably 1 to 70% by weight, particularly 5 to 50% by weight, based on the total amount of the pulp fiber and the components. The pulp fiber preferably comprises wood pulp of soft wood, bard wood, etc. and non-wood pulp of straw, bamboo, etc. The pulp fiber preferably has a length of 0.1 mm to 10 mm and a thickness of 0.01 mm to 0.05 mm.

On forming the pulp molded precursor 15 of prescribed thickness, the injection of the pulp slurry is stopped, and the cavity 13 is completely dewatered by sucking. Subsequently, as shown in FIG. 1(*b*), an inflatable pressing member 16 (a hollow stretchable elastic member 16 in this particular embodiment) is inserted into the cavity 13 while evacuating the cavity 13. The pressing member 16 is to be inflated in the cavity 13 like a balloon to press the pulp molded precursor 15 toward the inner wall of the cavity 13 thereby transferring the inner configuration of the cavity 13 and also dewatering the precursor by pressing. The pressing member 16 used in the embodiment is made of urethane, fluororubber, silicone rubber, elastomers, etc., which are excellent in tensile strength, impact resilience, stretchability, and the like.

As shown in FIG. 1(*c*), a pressurizing fluid is fed into the pressing member 16 to inflate it. The inflated pressing member 16 presses the pulp molded precursor 15 to the inner wall of the cavity 13. While the precursor 15 is pressed onto the inner wall of the cavity 13 by the inflated pressing member 16, the configuration of the inner wall of the cavity 13 is transferred to the precursor 15, and dewatering further proceeds at the same time. Since the precursor 15 is pressed from the inside to the inner wall of the cavity 13 in this manner, the inner configuration of the cavity 13 can be transferred to the precursor 15 with accuracy however complicated the configuration may be. Involving no step of joining unlike conventional methods, the resulting molded article has no seams nor thick-walled parts due to joining. As a result, the resulting molded article has secured strength and a satisfactory appearance. The pressurizing fluid for inflating the pressing member 16 includes compressed air (heated air), oil (heated oil) and other liquids. The pressure for feeding the pressurizing fluid is preferably 0.01 to 5 MPa, particularly 0.1 to 3 MPa. The pressurizing fluid may be heated.

After the configuration of the inner wall of the cavity 13 is sufficiently transferred to the pulp molded precursor 15, and the precursor 15 is dewatered to a prescribed water content, the pressurizing fluid is withdrawn from the pressing member 16, whereupon the pressing member 16 shrinks spontaneously to its original size as shown in FIG. 1(*d*). The shrunken pressing member 16 is taken out of the cavity 13, and the forming mold is opened to remove the wet pulp molded precursor 15 having the prescribed water content.

The pulp molded precursor 15 thus taken out is then subjected to the first heat drying step in the first heat drying means. In the first heat drying step, the same operation as in the papermaking step shown in FIG. 1 is conducted, except that papermaking and dewatering are not carried out. The first heat drying means comprises a heating mold which is composed of a pair of mold parts assembled together to form a cavity (depression) in conformity to the outer contour of a molded article to be produced, a pressing member for pressing the pulp molded precursor 15 which is set in the cavity (depression) of the heating mold toward the inner wall of the cavity, and a measuring instrument for measuring the water content, the weight or the temperature of the precursor 15.

In the first heat drying step, the heating mold is heated to a prescribed temperature, and the wet pulp molded precursor is set in the heated heating mold.

A pressing member similar to the pressing member 16 used in the papermaking step (i.e., an inflatable pressing member) is inserted into the pulp molded precursor, and a pressurizing fluid is fed into the pressing member to inflate it, whereby the precursor is pressed onto the inner wall of the cavity by the inflated pressing member. The material of the pressing member and the pressure for feeding the pressurizing fluid can be the same as those used in the papermaking step. In this state, the precursor is dried by heat. Interposed between the heating mold and the pressing member as an elastic member, the precursor is pressed between them. The first heat drying step is thus performed, and heat drying of the precursor 15 proceeds.

The progress of the heat drying of the pulp molded precursor 15 is monitored through measurement of the water content, weight or temperature of the precursor with the measuring instrument fitted to the first heat drying means.

The first heat drying step is terminated based on the data of water content, weight or temperature of the pulp molded precursor 15 from the measuring instrument, that is, when the data reaches a predetermined value. In this embodiment, the first heat drying step is stopped based on the water content of the precursor 15.

After the pulp molded precursor dries to the prescribed water content, the pressurizing fluid is withdrawn from the pressing member to make the pressing member shrink to its original size. The shrunken pressing member is taken out. The heating mold is opened to remove the precursor having the prescribed water content, which is transferred to a second heating means hereinafter described. Removal and transfer of the precursor 15 are carried out by a prescribed transfer means based on the data of water content, weight or temperature of the precursor as measured with the measuring instrument.

It is effective to remove the pulp molded precursor from the heating mold when the water content of the precursor is reduced by the hot pressing to 10 to 40% by weight, particularly 20 to 30% by weight. In detail, it has been revealed by the inventors' investigation that the drying mechanism changes at a water content in the above range. That is, the water held in the interstices among pulp fibers is removed by drying until the water content is reduced to about 30% by weight, showing a high rate of drying. When the water content is further decreased from about 30% by weight, water contained within the fibers begins to be removed, showing a reduced rate of drying. Accordingly, it is efficient to terminate the first drying step and switch over to the second drying step at the time point when the water content decreases to 40% by weight before the drying rate starts decreasing. Seeing that an equilibrium water content of a pulp molded article is 5 to 10% by weight in an ordinary environment, the lower limit of the water content of the precursor at which the first drying step should be switched over to the second drying step is preferably 10% by weight. Such water content control is also effective in preventing deformation, blistering, color change, and the like from occurring.

The term "blistering" refers to a phenomenon that the water content inside a pulp molded precursor, which is in a liquid state under a high pressure, vaporizes to abruptly increase its volume when pressure application (hot pressing) is stopped in the heat drying step, which causes delamination inside the precursor, resulting in lifting. Blistering can be suppressed by terminating the first drying step when the inside water content of the precursor falls to a prescribed value. If the precursor is taken out with too high a water content, the resulting molded article will have low strength, needing care in handling.

The term "water content" as used herein denotes the average water content of the whole pulp molded precursor. Where the pulp molded precursor has a wall thickness distribution or a water content distribution, the pulp molded precursor of which the average water content falls within the above-recited range may have some parts of which the water content is out of that range. For example, when the precursor of which the average water content falls within the above range has some parts of which the water content is less than the above range, it is desirable that the time required for the first heat drying step be slightly shortened so as to prevent the precursor from undergoing color change and the like.

Figure 2:
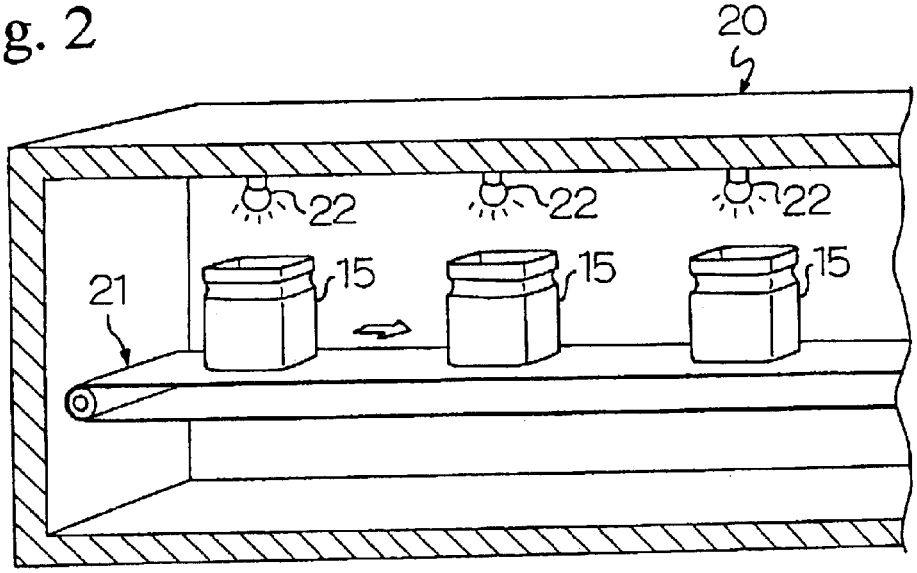
FIG. 2 schematically shows the second heat drying step in an embodiment of the method of producing a pulp molded article according to the present invention.

After completion of the first heat drying step, the pulp molded precursor having the prescribed water content which is taken out of the heating mold is subjected to a second heat drying step in a second heating means. The second heat drying step is conducted in a drying furnace 20 as shown in FIG. 2. The drying furnace 20 has therein a belt conveyer 21, on which a plurality of the pulp molded precursors 15 are conveyed while being irradiated with infrared ray or far-infrared ray 22. Desirably, ray irradiation is combined with hot air blowing (not shown) from the upper part of the drying over 20. The precursors 15 are thus dried completely or to a water content of 5 to 10% by weight. In the second heat drying step, since a plurality of the precursors 15 taken out of the heating mold can be heat-dried at a time, the heating mold can be used for the next heating cycle sooner than it would be when the precursor 15 is dried only in the first heat drying step. As a result, the production cycle is accelerated. Further, there is no need to increase the number of the heating molds to be prepared so that the cost of equipment can be saved. Furthermore, since the pulp molded precursors 15 have already been dried to a prescribed water content, drying completes in a short time without increasing the size of the drying furnace 20. Thus, a well-balanced combination of the first heat drying step and the second heat drying step makes it feasible to shorten the total production cycle time and to reduce the size of the drying equipment thereby reducing the production cost.

By carrying out the first heat drying step by hot pressing followed by the second heat drying step using a drying furnace and by properly adjusting the water content of the pulp molded precursor at the moment of transfer from the first heat drying step to the second one, (1) the resulting pulp molded article can have its density or flexibility controlled while retaining the surface smoothness and the surface strength, and (2) the durability of the pressing member can be lengthened. With respect to the advantage (1), where a pulp molded article having a low density and excellent flexibility is desired, the precursor is removed from the first heat drying step when its water content is in the range that does not cause deformation or blistering to obtain the precursor with a smooth surface and an enhanced surface strength. However, the density of the precursor is not high because the drying by pressing with the pressing member is ended at the time when a prescribed water content is reached. Then, the precursor taken out is subjected to the second heat drying step. As a result, there is obtained a pulp molded article having excellent surface smoothness and surface strength and yet a low density, i.e., high flexibility. With respect to the advantage (2), since the first heat drying step using the pressing member is ended when the water content is such that the temperature of the precursor is not raised too high, the pressing member is prevented from too much thermal damage, and the life of the pressing member is therefore extended.

If a molded article with low density and high flexibility is produced by the first heat drying step alone, the pressing by the pressing member must be conducted at a low pressure of about $1\times10^5$ to $2\times10^5$ Pa. As a result, the resulting molded article will have unfavorable low surface strength. In addition, because the contact between the precursor and the heating mold is insufficient due to the low pressing force, heat conductivity from the heating mold to the precursor is reduced to unfavorably increase the precursor drying time. On the other hand, if a molded article with low density and high flexibility is produced by the second heat drying step alone, the resulting molded article will have further reduced surface strength.

Figure 3:
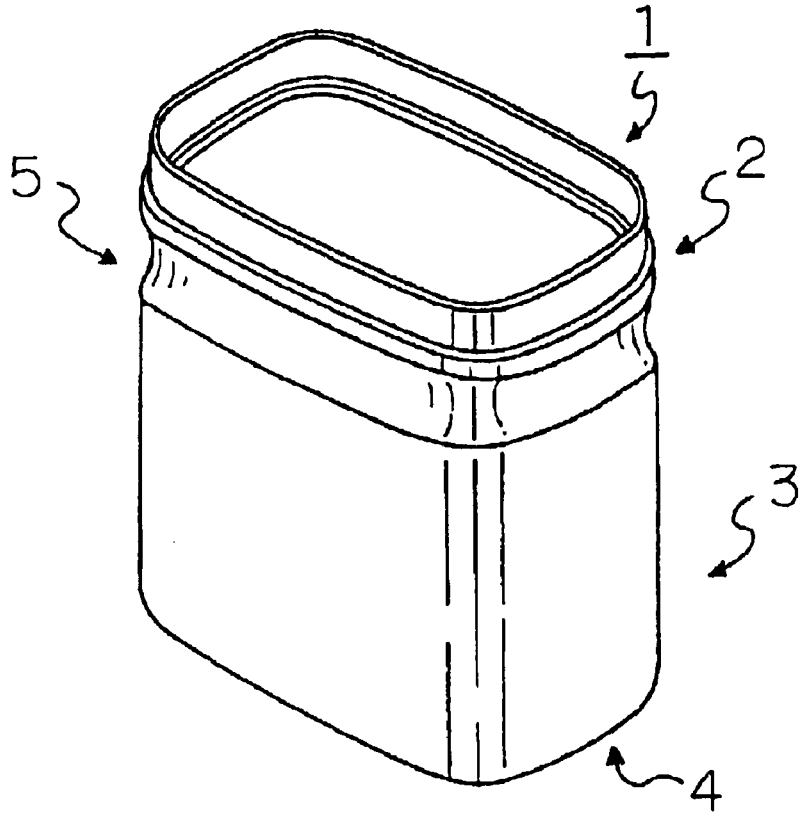
FIG. 3 is a perspective of an example of the pulp molded articles produced by the method according to the present invention.

A pulp molded article I thus obtained is a hollow object having an opening 2 at the top, a body 3, and a bottom 4 as shown in FIG. 3, which is useful as a hollow container especially suited to hold such contents as powder and granules. The pulp molded article 1 has an angle of approximately 90° between the contact plane of the bottom 4 and every side wall of the body 3 and is deep, having a height of 50 mm or more. The body 3 of the molded article 1 has a continuous depression 5 around its circumference. The molded article 1 has no joint seams nor thick-walled parts that would have been formed by joining. It has been practically impossible by conventional methods to produce the molded article 1 having such a shape, and there have been various restrictions on molded article designs. According to the method of the present invention, molded articles of various shapes including the above-mentioned pulp molded article I can easily be obtained with a shorter production cycle time at a lower production cost.

The present invention is not limited to the above-described embodiment, and various modifications can be made therein. For example, while in the above embodiment a forming mold and a heating mold are separately prepared, the forming mold 10 can serve as a heating mold.

The hot pressing in the first heat drying step may be carried out by use of a heating mold composed of a male mold and a female mold according to the shape of the pulp molded article to be produced.

The irradiation with infrared ray or far-infrared ray in the second heat drying step may be replaced with microwave drying at a prescribed frequency or, for preference, blowing hot air at a prescribed temperature as noted above. Drying with infrared or far-infrared ray or hot air is preferred because the equipment is inexpensive, and water can be removed efficiently. Microwave drying is capable of high-rate drying at high thermal efficiency and of heating the inside of objects and is therefore fit for drying thick-walled molded articles but needs expensive equipment. Any two or more of these three heating means can be used in combination in the second heat drying step.

For moisture-proofing or a like purpose, a coating agent may be applied to the surface of the pulp molded precursors after the first heat drying step and before the second heat drying step. In this case, drying of the coating agent and final drying of the precursors can be done simultaneously.

The production method of the present invention can be applied to bottle type hollow molded articles whose opening has a smaller opening area than the crosssectional area of the body. The method of the present invention is applicable to making of ornamental objects as well as hollow containers for holding contents.

EXAMPLES 1 AND 2 AND COMPARATIVE EXAMPLE 1

Pulp molded articles were produced by the method shown in FIGS. 1 and 2. The heat drying step in Examples 1 and 2 consisted of a first step in which pulp molded precursors were hot pressed and a second step in which the precursors were heat dried in a drying furnace. The heat drying step in Comparative Example 1 consisted of a single step in which the pulp molded precursors were heat dried in a drying furnace without using hot pressing. In each of Examples and Comparative Example, the final water content of the pulp molded articles was set at 5% by weight. The details of the conditions of the heat drying step are shown in Table 1. The molded articles were hollow bottles having an almost cylindrical shape which were designed to weigh 38 g and measure 240 mm in height and 80 mm in diameter of the body.

The conditions of papermaking, dewatering, and heat drying were as follows.

| | |
|---|---|
| Papermaking condition: | papermaking time: 15 sec. |
| Dewatering condition: | dewatering time: 20 sec.; water content after dewatering: 60% by weight |
| Hot pressing condition: | heating mold temperature: 220° C.; pressing force of pressing member: $6 \times 10^5$ Pa |
| Drying furnace condition: | hot air temperature: 170° C.; far-infrared heater temperature: 450° C.; hot air flow: 2 $m^3$/min |

The pulp molded articles obtained in Examples 1 and 2 and Comparative Example 1 were inspected for deformation and blistering in accordance with the following methods. The results are shown in Table 1.

Deformation of Molded Article:

The appearance of the pulp molded articles obtained by heat drying was observed with the naked eye and judged "not deformed" or "deformed". In addition, the outer diameter of the molded articles was measured with a laser measuring instrument. The molded article was placed upside down, and the outer diameter of the upright portion of the body, which was 45 to 180 mm high from the bottom, was measured at 2 mm intervals to obtain an average and a variation (standard deviation, 3σ).

Blistering of Molded Article:

The inner surface of the pulp molded articles obtained by heat drying was observed with the naked eye and judged "not having blisters" or "having blisters".

In addition to the inspection for deformation and blistering, the picking resistance of the molded article surface was determined. A disk plate having a diameter of 17 cm was prepared in the same manner as in Examples and Comparative Example, on which measurement was made in accordance with JIS P8129. As a result, it was revealed that the picking resistance varies from 7 to 11 depending on the conditions of pressing with the pressing member in the first heat drying step but does not vary with the water content at the time of removing the pulp molded article from the first heat drying step.

TABLE 1

| | Hot Pressing | | Drying | | Molded Article | | | |
|---|---|---|---|---|---|---|---|---|
| | Drying Time (sec) | Water Content at Removal (wt %) | Furnace Drying Time (min) | Total Drying Time | Deformation | Blistering | Average Body Outer Diameter (mm) | 3σ (mm) |
| Example 1 | 30 | 23 | 8 | 8'30" | not deformed | not having blistering | 79.3 | 1.1 |
| Example 2 | 40 | 16 | 5 | 5'40" | not deformed | not having blistering | 79.4 | 0.6 |
| Comparative Example 1 | — | — | 27 | 27' | deformed | not having blistering | 74.78 | 5–6 |

EXAMPLES 3 AND 4 AND COMPARATIVE EXAMPLE 2

Examples 3 and 4 were carried out in the same manner as in Example 1, except for changing the bottle shape of the molded articles to a box shape as shown in FIG. 3. Comparative Example 2 was the same as Comparative Example 1, except for changing the shape of the molded article to the box shape shown in FIG. 3. The details of the conditions of the heat drying step are shown in Table 2. The molded articles were designed to weigh 30 g and measure 80 mm in width, 150 mm in length, and 150 mm in height.

The conditions of papermaking, dewatering, and heat drying were as follows.

| | |
|---|---|
| Papermaking condition: | papermaking time: 12 sec. |
| Dewatering condition: | dewatering time: 20 sec.; water content after dewatering: 60% by weight |
| Hot pressing condition: | heating mold temperature: 200° C.; pressing force of pressing member: $4.4 \times 10^5$ Pa |
| Drying furnace condition: | hot air temperature: 170° C.; far-infrared heater temperature: 450° C.; hot air flow: 2 $m^3$/min |

The pulp molded articles obtained in Examples 3 and 4 and Comparative Example 2 were inspected for deformation and blistering in the same manner as described above, except that deformation was evaluated by visual check only. The results obtained are shown in Table 2.

TABLE 2

| | Hot Pressing | | Drying | Total | Molded Article | |
|---|---|---|---|---|---|---|
| | Drying Time (sec) | Water Content at Removal (wt %) | Furnace Drying Time (min) | Drying Time | Deformation | Blistering |
| Example 3 | 40 | 32 | 11 | 11'40" | not deformed | not having blistering |
| Example 4 | 70 | 16 | 5 | 6'10" | not deformed | not having blistering |
| Comparative Example 2 | — | — | 24 | 24' | deformed | not having blistering |

As is apparent from the results shown in Tables 1 and 2, when heat drying of pulp molded precursors are carried out by means of a drying furnace alone, the drying time in the drying furnace becomes longer, which indicates the need of a larger drying furnace, and the molded article suffers from deformation.

As is apparent from the results in Table 1, the pulp molded articles of Examples have their average body outer diameter approximate to the mold dimension, i.e., 80 mm, proving that their shrinkage on heat drying is smaller than that of the comparative pulp molded article. In particular, a comparison between Examples 1 and 2 reveals that Example 2 in which the water content of the precursor at removal from the first heat drying step is smaller achieves further approximation of the average body outer diameter to the mold dimension, i.e., 80 mm, which shows further suppression of shrinkage on heat drying.

From the foregoing, it is understood that molded articles can be prevented from undergoing deformation or blistering, the total drying step completes in a shorter time, and the size of drying equipment can be reduced by carrying out the first heat drying step by hot pressing followed by the second heat drying step using a drying furnace and by making a switch from the first step to the second one at the moment when the water content of the pulp molded precursor comes into a prescribed range.

While not shown in Tables, the pulp molded articles obtained in Examples had high surface smoothness and flexibility.

Industrial Applicability:

The method of producing a pulp molded article according to the present invention brings about reductions in drying time and size of drying equipment thereby achieving reduction of production cost.

The method of producing a pulp molded article according to the present invention provides a pulp molded article with controlled density or flexibility while maintaining certain surface strength and thus having rigidity or flexibility fit to a particular use by properly adjusting the water content at the switch from the first heat drying step to the second one.

The method of producing a pulp molded article of the present invention provides molded articles of various shapes with ease and at low production cost without restrictions on molded article designing.

The method of producing a pulp molded article of the present invention provides deep molded articles with no seams nor thick-walled parts due to joining.

What is claimed is:

1. A method for producing a pulp molded article, comprising:

forming a precursor by depositing a pulp slurry on a surface of a cavity having a predetermined configuration in a forming mold;

heat drying the precursor, wherein the heat drying includes:

setting the precursor between a cavity of a heating mold and an inflatable pressing member, the cavity having the predetermined configuration, and pressing the precursor against the heating mold, and removing the precursor from the heating mold and heat drying the precursor in a drying furnace.

2. The method for producing a pulp molded article according to claim 1, wherein the heat drying comprises a combination of hot air blowing and infrared or far-infrared ray irradiation.

3. The method for producing a pulp molded article according to claim 1, wherein the forming mold comprises a set of mold parts which are assembled together to form the cavity.

4. The method for producing a pulp molded article according to claim 1, wherein the hot-pressed precursor is taken out from the heating mold when a water content of the precursor is reduced to 10 to 40% by weight.

5. An apparatus for producing a pulp molded article which is used in the method of producing a pulp molded article according to claim 1, the apparatus comprising:

means for molding;

means for pressing a pulp molded precursor in the means for molding;

means for measuring at least one of water content, weight, or temperature of the precursor;

means for heat drying the precursor; and means for transferring the precursor from the means for molding to the means for heat drying based on the at least one of water content, weight, or temperature determined by the means for measuring.

6. A method for producing a pulp molded article, comprising:

forming a pulp molded precursor from a pulp slurry using a forming mold and then heat-drying the precursor, wherein the heat-drying includes:

setting the precursor between a cavity of a heating mold and an inflatable pressing member, the cavity having a predetermined configuration, and pressing the precursor against the heating mold, and removing precursor from the heating mold and drying the precursor in a furnace by infrared or far-infrared ray irradiation.

* * * * *